US007085393B1

(12) United States Patent
Chen

(10) Patent No.: US 7,085,393 B1
(45) Date of Patent: Aug. 1, 2006

(54) METHOD AND APPARATUS FOR REGULARIZING MEASURED HRTF FOR SMOOTH 3D DIGITAL AUDIO

(75) Inventor: Jiashu Chen, Homdel, NJ (US)

(73) Assignee: Agere Systems Inc., Allentown, PA (US)

( * ) Notice: Subject to any disclaimer, the term of this patent is extended or adjusted under 35 U.S.C. 154(b) by 0 days.

(21) Appl. No.: 09/190,207

(22) Filed: Nov. 13, 1998

Related U.S. Application Data

(63) Continuation of application No. 09/191,179, filed on Nov. 13, 1998, now abandoned.

(51) Int. Cl.
*H04R 5/02* (2006.01)

(52) U.S. Cl. ..... 381/310; 381/1; 381/17

(58) Field of Classification Search ..... 381/1, 381/17, 18, 26, 74, 309, 310; 463/135, 35
See application file for complete search history.

(56) References Cited

U.S. PATENT DOCUMENTS 5,500,900 A * 3/1996 Chen et al. ..... 381/17
5,659,619 A * 8/1997 Abel

OTHER PUBLICATIONS

Poggio et al, From Regularization to radial, tensor and additive splines. Neural Networks for signal processing [1993], pp. 223-227.*

Jiashu Chen, et al., "A Spatial Feature Extraction and Regularization Model for the Head-Related Transfer Function," Journal of Acoustical Society of America, Jan. 1995, pp. 439-452.

Jiashu Chen, et al., "External Ear Transfer Function Modeling: A Beamforming Approach," Journal of Acoustical Society of America, Oct. 1992, pp. 1933-1944.

Richard A. Reale, et al., "Am Implementation of Virtual Acoustic Space for Neurophysiological Studies of Directional Hearing," Virtual Auditory Space: Generation and Applications, Chapter 5, 1996, pp. 153-183.

* cited by examiner

*Primary Examiner*—Duc Nguyen

(57) ABSTRACT

The present invention provides an improved HRTF modeling technique for synthesizing HRTFs with varying degrees of smoothness and generalization. A plurality N of spatial characteristic function sets are regularized or smoothed before combination with corresponding Eigen filter functions, and summed to provide an HRTF (or HRIR) filter having improved smoothness in a continuous auditory space. A trade-off is allowed between accuracy in localization and smoothness by controlling the smoothness level of the regularizing models with a lambda factor. Improved smoothness in the HRTF filter allows the perception by the listener of a smoothly moving sound rendering free of annoying discontinuities creating clicks in the 3D sound.

12 Claims, 3 Drawing Sheets

METHOD AND APPARATUS FOR REGULARIZING MEASURED HRTF FOR SMOOTH 3D DIGITAL AUDIO

This application is a continuation of U.S. patent application Ser. No. 09/191,179 entitled "Method and Apparatus for Regular Rising Measured HTRF for Smooth 3D Digital Audio" filed Nov. 13, 1998 now abandoned.

BACKGROUND OF THE INVENTION

1. Field of the Invention

This invention relates generally to three dimensional (3D) sound. More particularly, it relates to an improved regularizing model for head-related transfer functions (HRTFs) for use with 3D digital sound applications.

2. Background of Related Art

Some newly emerging consumer audio devices provide the option for three-dimensional (3D) sound, allowing a more realistic experience when listening to sound. In some applications, 3D sound allows a listener to perceive motion of an object from the sound played back on a 3D audio system.

Extensive research has established that human localize sound source location by using three major acoustic cues, the interaural time difference (ITD), interaural intensity difference (IID), and head-related transfer functions (HRTFs). Note that the time domain equivalent of HRTF is usually termed head-related impulse response (HRIR). Both HRTF and HRIR are interchangeably used in this invention wherever they fit the context. These cues, in turn, are used in generating 3D sound in 3D audio systems. Among these three cues, ITD and IID occur when sound, from a source in space, arrive at both ears of a listener. When the source is at a arbitrary location in space, the sound wave arrives at both ears with different time delays due the unequal path length of wave propagation. This creates the ITD. Also, due to the head shadowing effects, the intensity of the sound waves arriving at both ears can be unequal. This creates the IID.

When the sound source is in the median plane of the head, both ITD and IID become trivial. However, the listener still can localize sound in terms of its elevation, and some degree of lateralization. This effect, confirmed by recent research, is due to the filtering effects of head, torso, shoulders, and more importantly, the pinnae, collectively termed as external ear. In particular, external ear can be viewed as a set of acoustical resonators, the resonance frequency of each equivalent resonator varies with respect to the in-coming angle of the sound source. Verified by measured HRTFs, these resonance frequencies manifest themselves as peaks and valleys in the spectra of the measured HRTFs. Moreover, these peaks and valleys change their center frequency with respect to sound source position change.

In order to synthesize a positioned 3D audio source, a particular set of ITD, IID, and a pair of HRTF has to be used. In order to simulate the motion of the sound source, in addition to the varying ITD and IID, many HRTF pairs have to be used to obtain a continuous moving sound image. In the prior arts, hundreds or thousands of measured HRTFs are used to fulfill this purpose. There are problems with this approach. This first problem is that the HRTFs are obtained with sound source at discrete locations in the space, thus not providing continuum of the HRTF function. The second problem is that the measured HRTFs contain measurement error and thus are not smooth. Both problems cause annoying clicks in simulating sound source motion, when discontinued HRTFs are switched in and out of the filtering loop.

One conventional solution to the adaptation of a discretely measured HRTF within a continuous auditory space is to "interpolate" the measured HRTFs by linearly weighting the neighboring impulse responses. This can provide a small step size for incremental changes in the HRTF from location to location. However, interpolation is conceptually incorrect because it does not account for the fact that linear combination of adjacent impulse responses increases the number of overall peaks and valleys involved, and thus significantly compromises the quality of the interpolated HRTF. This method, called direct convolution, is shown in FIG. 3. In particular, 460 is the sound source to be 3D positioned. 410 and 412 are left channel and right channel delays, together to form ITD. 420 and 422 are left and right ear HRTFs. 430 and 432 are signals either can be sent to left and right ear for listening or can be sent to next stage for further processing.

Other attempted solutions include using one HRTF for a large area of the three-dimensional space to reduce the frequency of discontinuities which may cause a clicking sound. However, again, such solutions compromise the overall quality of the 3D sound rendering.

There is thus a need for a more accurate HRTF model which provides a suitable HRTF for source locations in a continuous auditory space, without annoying discontinuities.

SUMMARY OF THE INVENTION

In accordance with the principles of the present invention, a head-related transfer function or head-related impulse response model for use with 3D sound applications comprises a plurality of eigen filters EFs). A plurality of spatial characteristic functions (SCFs) are adapted to be respectively combined with the plurality of Eigen filters. A plurality of regularizing models are adapted to regularize the plurality of spatial characteristic functions prior to the respective combination with the plurality of Eigen filters.

A method of determining SCFs for use in a head-related transfer function model or a head-related impulse response model in accordance with another aspect of the present invention comprises constructing a covariance data matrix of a plurality of measured head-related transfer functions or a plurality of measured head-related impulse responses. An Eigen decomposition of the covariance data matrix is performed to provide a plurality of eigen filters. At least one principal Eigen vector is determined from the plurality of eigen filters. The measured head-related transfer functions or head-related impulse responses are projected to the at least one principal Eigen filter to create the spatial characteristic sets. The SCF sample sets are fed into a generalized spline model for regularization for interpolation and smoothing. The regularized SCFs are then linearly combined with EFs to generate HRTFs or HRIRs that both continuous and smooth for a high quality and click-free 3D audio rendering.

BRIEF DESCRIPTION OF THE DRAWINGS

Features and advantages of the present invention will become apparent to those skilled in the art from the following description with reference to the drawings, in which.

DETAILED DESCRIPTION OF ILLUSTRATIVE EMBODIMENTS

Conventionally measured HRIRs are obtained by presenting a stimulus through a loudspeaker positioned at many locations in a three-dimensional space, and at the same time collecting responses from a microphone embedded in a mannequin head or a real human subject. To simulate a moving sound, a continuous HRIR that varies with respect to the source location is needed. However, in practice, only a limited number of HRIRs can be collected in discrete locations in any given 3D space.

Limitations in the use of measured HRIRs at discrete locations have led to the development of functional representations of the HRIRs, i.e., a mathematical model or equation which represents the HRIR as a function of time and direction. Simulation of 3D sound is then performed by using the model or equation to obtain the desired HRIR or HRTF.

Moreover, when discretely measured HRIRs are used, annoying discontinuities can be perceived by the listener from a simulated moving sound source as a series of clicks as the sound object moves with respect to the listener. Further analyses indicates that the discontinuities may be the consequence of, e.g., instrumentation error, under-sampling of the three-dimensional space, a non-individualized head model, and/or a processing error. The present invention provides an improved HRIR modeling method and apparatus by regularizing the spatial attributes extracted from the measured HRIRs to obtain the perception of a smooth moving sound rendering without annoying discontinuities creating clicks in the 3D sound.

Figure 1:
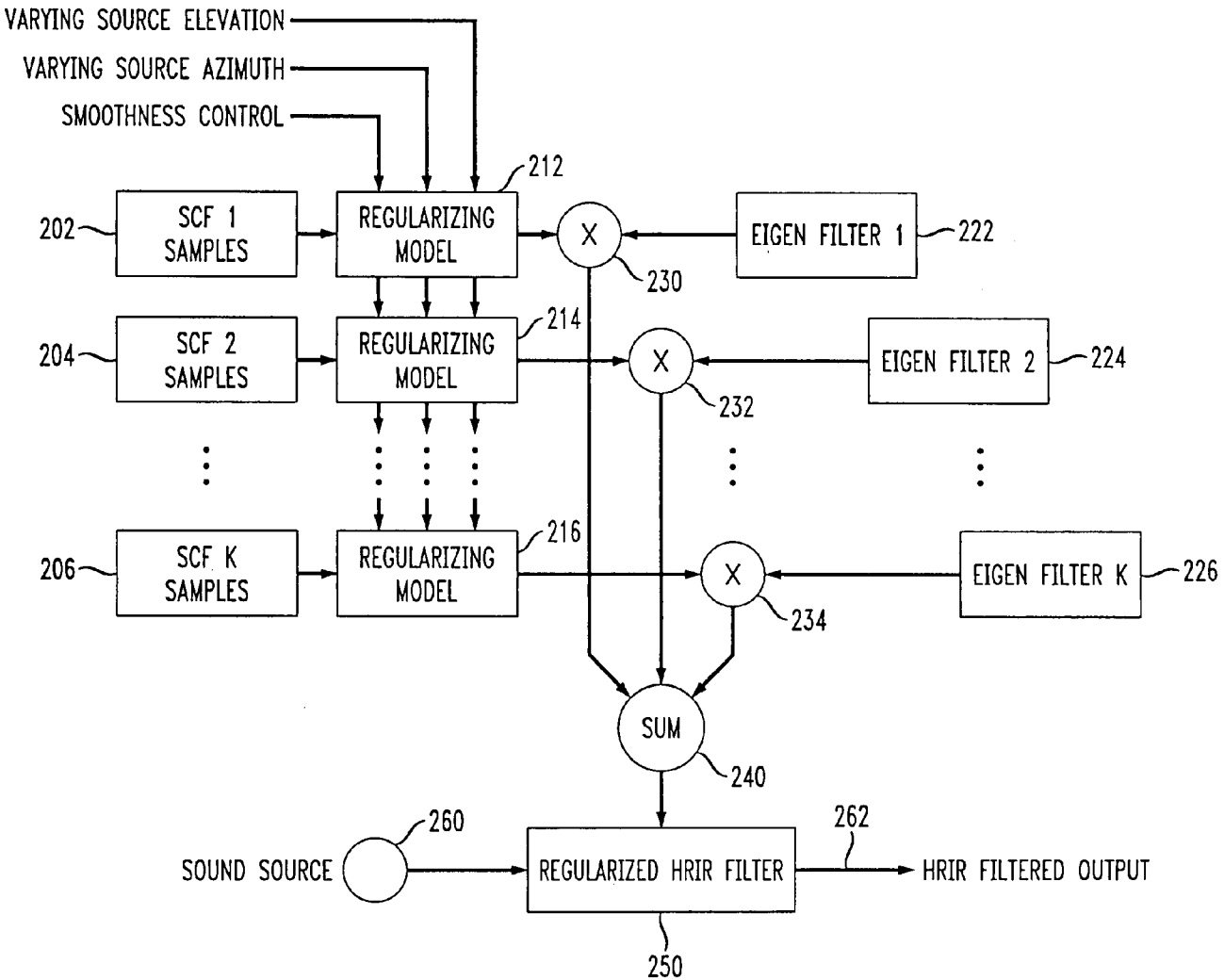
FIG. 1 shows an implementation of a plurality of Eigen filters to a plurality of regularizing models each based on a set of SCF samples, to provide an HRTF model having varying degrees of smoothness and generalization, in accordance with the principles of the present invention.

HRIRs corresponding to specific azimuth and elevation can be synthesized by linearly combining a set of so-called Eigen-transfer functions (EFs) and a set of spatial characteristic functions (SCFs) for the relevant auditory space, as shown in FIG. 1 herein, and as described in "An Implementation of Virtual Acoustic Space For Neurophysiological Studies of Directional Hearing" by Richard A. Reale, Jiashu Chen et al. in *Virtual Auditory Space: Generation and Applications*, edited by Simon Carlile (1996); and "A Spatial Feature Extraction and Regularization Model for the Head-Related Transfer Function" by Jiashu Chen et al. in *J. Acoust. Soc. Am.* 97 (1) (January 1995), the entirety of both of which are explicitly incorporated herein by reference.

In accordance with the principles of the present invention, spatial attributes extracted from the HRTFs are regularized before combination with the Eigen transfer function filters to provide a plurality of HRTFs with varying degrees of smoothness and generalization.

Figure 3:
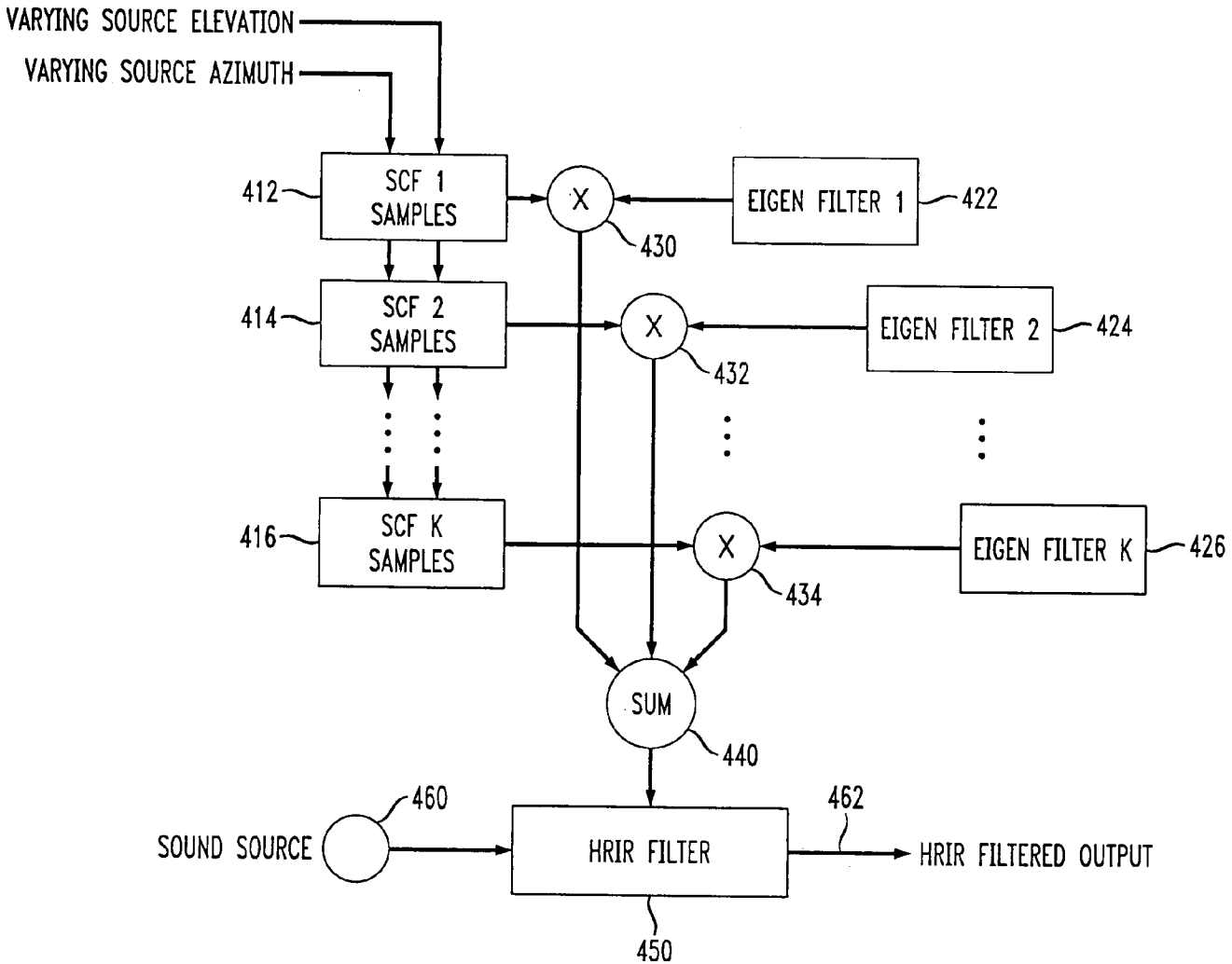
FIG. 3 PRIOR ART
FIG. 3 shows a conventional solution wherein direct convolution of dry signal and HRTFs to provide 3D positioned audio signals.

FIG. 1 shows an implementation of the regularization of a number N of SCF sample sets 202–206 in an otherwise conventional system as shown in FIG. 3.

In particular, a plurality N of Eigen filters 222–226 are associated with a corresponding plurality N of SCF samples 202–206. A plurality N of regularizing models 212–216 act on the plurality N of SCF samples 202–206 before the SCF samples 202–206 are linearly combined with their corresponding Eigen filters 222–226. Thus, in accordance with the principles of the present invention, SCF sample sets are regularized or smoothed before combination with their corresponding Eigen filters.

The particular level of smoothness desired can be controlled with a smoothness control to all regularizing models 212–216, to allow the user to adjust a tradeoff between smoothness and localization of the sound image. The regularizing models 212–216 in the disclosed embodiment performs a so-called 'generalized spline model' function on the SCF sample sets 202–206, such that smoothed continuous SCF sets are generated at combination points 230–234, respectively. The degree of smoothing, or regularization, can be controlled by a lambda factor, with trade-offs of the smoothness of the SCF samples with their acuity.

The results of the combined Eigen filters 222–226 and corresponding regularized SCF sample sets 202–206/212–216 are summed in a summer 240. The summed output from the summer 240 provides a single regularized HRTF (or HRIR) filter 250 through which the digital audio sound source 260 is passed, to provide an HRTF (or HRIR) filtered output 262.

The HRTF filtering in a 3D sound system in accordance with the principles of the present invention may be performed either before or after other 3D sound processes, e.g., before or after an interaural delay is inserted into an audio signal. In the disclosed embodiment, the HRTF modeling process is performed after insertion of the interaural delay.

The regularizing models 212–216 are controlled by a desired location of the sound source, e.g., by varying a desired source elevation and/or azimuth.

Figure 2:
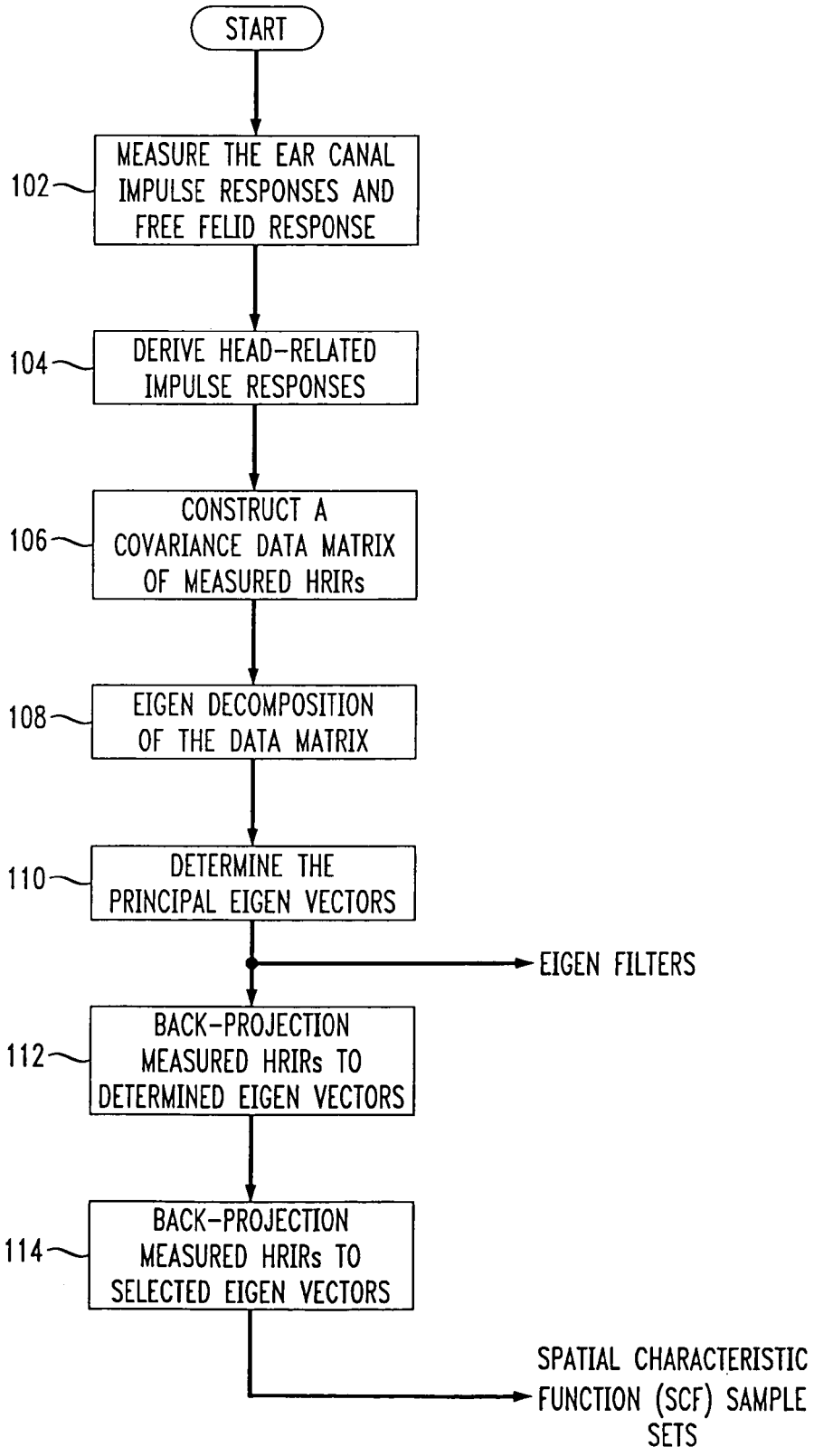
FIG. 2 shows a process for determining the principle Eigen vectors to provide Eigen filters used in the Eigen filters shown in FIG. 1, in accordance with the principles of the present invention.

FIG. 2 shows an exemplary process of providing the Eigen functions for the Eigen filters 222–226 and the SCF sample sets 202–206, e.g., as shown in FIG. 1, to provide an HRTF model having varying degrees of smoothness and generalization in accordance with the principles of the present invention.

In particular, in step 102, the ear canal impulse responses and free field response are measured from a microphone embedded in a mannequin or human subject. The responses are measured with respect to a broadband stimulus sound source that is positioned at a distance about 1 meter or farther away from the microphone, and preferably moved in 5 to 15 degree intervals both in azimuth and elevation in a sphere.

In step 104, the data measured in step 102 is used to derive the HRIRs using a discrete Fourier Transform (DFT) based method or other system identification method. Since the HRIRs are either in a frequency or time domain form, and since they vary with respect to their respective spatial location, HRIRs are generally considered as a multivariate function with frequency (or time) and spatial (azimuth and elevation) attributes.

In step 106, an HRTF data covariance matrix is constructed either in the frequency domain or in the time domain. For instance, in the disclosed embodiment, a covariance data matrix of measured head-related impulse responses (HRIR) are measured.

In step 108, an Eigen decomposition is performed on the data covariance matrix constructed in step 106, to order the Eigen vectors according to their corresponding Eigen values. These Eigen vectors are a function of frequency only and are abbreviated herein as "EFs". Thus, the HRIRs are expressed as weighted combinations of a set of complex valued Eigen transfer functions (EFs). The EFs are an orthogonal set of frequency-dependent functions, and the weights applied to each EF are functions only of spatial location and are thus termed spatial characteristic functions (SCFs).

In step 110, the principal Eigen vectors are determined. For instance, in the disclosed embodiment, an energy or power criteria may be used to select the N most significant Eigen vectors. These principal Eigen vectors form the basis for the Eigen filters 222–226 (FIG. 1).

In step 112, all the measured HRIRs are back-projected to the principal Eigen vectors selected in step 110 to obtain N sets of weights. These weight sets are viewed as discrete samples of N continuous functions. These functions are two dimensional with their arguments in azimuthal and elevation angles. They are termed spatial characteristic functions (SCFs). This process is called spatial feature extraction.

Each HRTF, either in its frequency or in its time domain form, can be re-synthesized by linearly combining the Eigen vectors and the SCFs. This linear combination is generally known as Karhunen-Loeve expansion.

Instead of directly using the derived SCFs as in conventional systems, e.g., as shown in FIG. 3, they are processed by a so-called "generalized spline model" in regularizing models 212–216 such that smoothed continuous SCF sets are generated at combinatorial points 230–234. This process is referred to as spatial feature regularization. The degree of smoothing, or regularization, can be controlled by a smoothness control with a lambda factor, providing a trade-off between the smoothness of the SCF samples 202–206 and their acuity.

In step 114, the measured HRIRs are back-projected to the principal Eigen vectors selected in step 110 to provide the spatial characteristic function (SCF) sample sets 202–206.

Thus, in accordance with the principles of the present invention, SCF samples are regularized or smoothed before combination with a corresponding set of Eigen filters 222–226, and recombined to form a new set of HRIRs.

In accordance with the principles of the present invention, an improved set of HRIRs are created which, when used to generate moving sound, do not introduce discontinuities causing the annoying effects of clicking sound. Thus, with empirically selected lambda values, localization and smoothness can be traded off against one another to eliminate discontinuities in the HRIRs.

While the invention has been described with reference to the exemplary embodiments thereof, those skilled in the art will be able to make various modifications to the described embodiments of the invention without departing from the true spirit and scope of the invention.

What is claimed is:

1. A head-related transfer function (HRTF) model for use with 3D sound applications, comprising:

a plurality of Eigen filters;

a plurality of sets of spatial characteristic function (SCF) samples derived from one or more HRTFs and adaptively combined with said plurality of Eigen filters; and a plurality of regularizing models, each regularizing model adapted to regularize a different set of the SCF samples based on a different smoothness factor prior to said respective combination with said plurality of Eigen filters to provide a plurality of head related transfer functions with controllable degrees of smoothness, wherein each different smoothness factor trades off between smoothness and localization for the corresponding set of SCF samples.

2. The head-related transfer function model for use with 3D sound applications according to claim 1, further comprising:

a summer operably coupled to said plurality of combined Eigen filters combined with said plurality of regularized spatial characteristic functions to provide said head-related transfer function model.

3. The head-related transfer function model for use with 3D sound applications according to claim 1, wherein:

said plurality of regularizing models are each adapted to perform a generalized spline model.

4. The head-related transfer function model for use with 3D sound applications according to claim 1, further comprising:

a smoothness control operably coupled with said plurality of regularizing models to allow control of a trade-off between localization and smoothness of said head-related transfer function.

5. A head-related impulse response (HRIR) model for use with 3D sound applications, comprising:

a plurality of Eigen filters;

a plurality of sets of spatial characteristic function (SCF) samples derived from one or more HRIRs and adapted to be respectively combined with said plurality of Eigen filters;

a plurality of regularizing models, each regularizing model adapted to regularize a different set of the SCF samples based on a different smoothness factor prior to said respective combination with said plurality of Eigen filters, wherein each different smoothness factor trades off between smoothness and localization for the corresponding set of SCF samples; and a single regularized head-related transfer function filter produced by summing said Eigen filters and said regularized SCF samples.

6. The head-related impulse response model for use with 3D sound applications according to claim 5, further comprising:

a summer adapted to sum said plurality of combined Eigen filters combined with said plurality of regularized spatial characteristic functions to provide said head-related impulse response model.

7. The head-related impulse response model for use with 3D sound applications according to claim 5, wherein:

said plurality of regularizing models are each adapted to perform a generalized spline model.

8. The head-related transfer function model for use with 3D sound applications according to claim 5, further comprising:

a smoothness control in communication with said plurality of regularizing models to allow control of a trade-off between localization and smoothness of said head-related transfer function.

9. A method of determining spatial characteristic function (SCF) sample sets for use in a head-related transfer function model, comprising:

constructing a covariance data matrix of a plurality of measured head-related transfer functions;

performing an Eigen decomposition of said covariance data matrix to provide a plurality of Eigen vectors;

determining at least one principal Eigen vector from said plurality of Eigen vectors;

projecting said measured head-related transfer functions back to said at least one principal Eigen vector to create said spatial characteristic sets; and respectively regularizing each different set of the SCF samples by corresponding regularizing model based on a different smoothness factor prior to being combined with a plurality of Eigen filters to provide a plurality of regularized head-related transfer functions with controllable degrees of smoothness, wherein each different smoothness factor trades off between smoothness and localization for the corresponding set of SCF samples.

10. A method of determining spatial characteristic function (SCF) sample sets for use in a head-related impulse response model, comprising:

constructing a covariance data matrix of a plurality of measured head-related impulse responses;

performing an Eigen decomposition of said time domain covariance data matrix to provide a plurality of Eigen vectors;

determining at least one principal Eigen vector from said plurality of Eigen vectors;

back-projecting said measured head-related impulse responses to said at least one principal Eigen vector to create said spatial characteristic sets; and respectively regularizing each different set of the SCF samples by a corresponding regularizing model based on a different smoothness factor prior to being combined with a plurality of Eigen filters to provide a plurality of regularized head-related impulse responses with controllable degrees of smoothness, wherein each different smoothness factor trades off between smoothness and localization for the corresponding set of SCF samples.

11. Apparatus for determining spatial characteristic function (SCF) sample sets for use in a head-related transfer function model, comprising:

means for constructing a covariance data matrix of a plurality of measured head-related transfer functions;

means for performing an Eigen decomposition of said covariance data matrix to provide a plurality of Eigen vectors;

means for determining at least one principal Eigen vector from said plurality of Eigen vectors; and means for back-projecting said measured head-related transfer functions to said at least one principal Eigen vector to create said spatial characteristic sets; and means for respectively regularizing each different set of the SCF samples by a corresponding regularizing model based on a different smoothness factor prior to being combined with a plurality of Eigen filters to provide a plurality of regularized HRTFs with controllable degrees of smoothness, wherein each different smoothness factor trades off between smoothness and localization for the corresponding set of SCF samples.

12. Apparatus for determining spatial characteristic function (SCF) sample sets for use in a head-related impulse response model, comprising:

means for constructing a covariance data matrix of a plurality of measured head-related impulse responses;

means for performing an Eigen decomposition of said time domain covariance data matrix to provide a plurality of Eigen vectors;

means for determining at least one principal Eigen vector from said plurality of Eigen vectors;

means for back-projecting said measured head-related impulse responses to said at least one principal Eigen vector to create said spatial characteristic sets; and means for respectively regularizing each different set of the SCF samples by a corresponding regularizing model based on a different smoothness factor prior to being combined with a plurality of Eigen filters to provide a plurality of regularized head-related impulse responses with controllable degrees of smoothness, wherein each different smoothness factor trades off between smoothness and localization for the corresponding set of SCF samples.

* * * * *